US005566566A

United States Patent [19]

Harper

[11] Patent Number: 5,566,566

[45] Date of Patent: Oct. 22, 1996

[54] METHOD OF MAKING A PAPER CLIP

[75] Inventor: Matthew C. Harper, Thousand Oaks, Calif.

[73] Assignee: Scott L. Brotzman, Alta Loma, Calif.

[21] Appl. No.: 458,810

[22] Filed: Jun. 2, 1995

Related U.S. Application Data

[63] Continuation-in-part of Ser. No. 186,997, Jan. 27, 1994, abandoned.

[51] Int. Cl.[6] ..... B21D 28/10; B21D 53/36

[52] U.S. Cl. ..... 72/336; 29/13; 402/14; 24/67 CF

[58] Field of Search ..... 72/336, 337, 325; 29/13; 402/14–17; 24/67 CF, 67.9, 67 R

[56] References Cited

U.S. PATENT DOCUMENTS

| | | | |
|---|---|---|---|
| 171,712 | 1/1876 | Adair | 402/14 |
| 857,488 | 6/1907 | Rosenthal | 24/67 R |
| 1,637,832 | 8/1927 | Miller | 402/14 |
| 2,224,993 | 12/1940 | Swift | 29/13 |
| 2,268,080 | 12/1941 | Novick | 29/13 |
| 2,543,144 | 2/1951 | Wold | 402/15 |
| 4,356,719 | 11/1982 | Sutherland | 72/336 |

FOREIGN PATENT DOCUMENTS

| | | | |
|---|---|---|---|
| 24908 | of 1896 | United Kingdom | 402/15 |

*Primary Examiner*—Daniel C. Crane
*Attorney, Agent, or Firm*—Jack C. Munro

[57] ABSTRACT

The method of making a paper clip to secure a plurality of sheets of paper together which are located in a stacked relationship. The paper clip produced by the method of this invention comprises a rigid sheet material metallic or composite body which is bendable and when bent, remains in the bent position. The method includes placing the overall configuration of the paper clip on the exterior planar surface of a thin sheet of metal or composite with the configuration of the paper clip including a pair of spaced-apart, normally triangularly shaped wings. Severing the exterior edges of the wings from the sheet of metal. Partially deflecting of the wings from the sheet of metal to a canted position relative to the sheet of metal and with the further possibility of deflecting of the wings by forcing the wings to a side by side relationship with the remaining body of the paper clip. Severing the remaining exterior edge of the paper clip and removing of the paper clip from the sheet of metal.

12 Claims, 1 Drawing Sheet

METHOD OF MAKING A PAPER CLIP

REFERENCE TO PRIOR APPLICATION

This application is a continuation-in-part of patent application Ser. No. 08/186,997, filed Jan. 27, 1994, by the same title, now abandoned.

BACKGROUND OF THE INVENTION

The field of this invention relates to fasteners and more particularly to the method of making a fastener to be used for connecting together a plurality of sheets of paper which are located in a stacked relationship.

DESCRIPTION OF THE PRIOR ART

The use of paper clips or paper fasteners has long been known. A typical paper clip is made of wire with a plurality of sheets of paper to be located between different sections of the wire clip thereby binding the sheets of paper together. Other types of paper fasteners have long been known such as fasteners which extend through aligned holes in pieces of paper with some type of a metallic or string type of fastening arrangement being located through the hole. However, this particular type of arrangement has the undesirable feature of mutilating the sheets of paper which is not particularly attractive when used in conjunction with business letters or legal documents.

Still another exceedingly common used paper clip is referred to as a staple. The staple actually punctures through the sheets of paper and the staple is bent over on itself binding the sheets of paper together. The staple works most satisfactorily. However, a staple is not a particularly attractive paper fastener. Also, the staple utilizes the undesirable feature of puncturing the sheets of paper forming holes.

In the past it has been known to make paper fasteners or paper clips from metal sheet material which is bent and when bent will stay in the bent configuration. These prior types of paper fasteners are to be applied to a corner of a stacked series of polygonal shaped sheets of paper. These types of paper fasteners have the advantage of not puncturing or defacing the sheets of paper. However, these types of paper fasteners in the prior art have only been produced as high volume generic products functionally limited by the number of sheets of paper which can be secured by a paper clip with a single score or non-expansive bend line in the bending joints of the paper clip. The paper clip is only produced in a smaller size which does not incorporate a facia area large enough to effectively personalize. These prior art paper clips are produced in high volume with the only differentiation being that of color or of a slightly different generic facia pattern. The tooling used to make these prior art paper clips does not incorporate the versatility of use of the present invention which allows for quick change use of tooling necessary for production of personalized versions of the paper clip at an economically feasible cost.

However, the present inventor constructed a paper clip which was manufacturable to be quite attractive, with the ability to individualize the facia area of the clip. This is normally achieved by using the cost effective production method of splitting the embossing inserts of the paper clip into two sections which are normally chemically, mechanically or manually embossed. The paper securing section of the paper clip is normally unchanged. With the individualized embossing inserts of the facia area being changed for individualized production runs. Due to this flexibility of production of the present invention, the product has been experiencing significant interest which has resulted in an encouraging amount of positive market interest for the product. This paper clip is covered by U.S. Pat. No. 5,272,792, issued Dec. 28, 1993. Within the prior art, bent types of clips have not been manufactured easily which has also deterred their widespread usage. The paper clips must be constructed from a quite thin sheet of material, metal or composite. The manufacturing must be accomplished to produce a high volume of the paper clips with quick change embossing inserts interchangeable within a very short period of time. A major problem has been in the past that the manufacture of such paper clips was limited by production of only small generic paper clips as opposed to individualized versions.

SUMMARY OF THE INVENTION

The main embodiment of the method of making a paper clip of the present invention constitutes placing of the overall configuration of the paper clip onto an outer planar surface of the thin sheet of metal or composite material. This placing of the overall configuration can be of numerous techniques such as printing, embossing, chemical etching, lamination, roll forming, with probably stamping being preferred. Known stamping techniques that could be used include fine blanking and four slide. The paper clip has an exterior edge and also has a pair of spaced-apart normally triangularly shaped wings. The edge located exteriorly of each of the wings is then severed in a separate manufacturing step. However, there may remain a non-severed section of the edge located between the wings to fix the angle of the triangular folding wings. In another manufacturing step, each of the wings are then partially deflected to assume a canted position relative to the sheet of metal or main body of the paper clip. Then in a separate manufacturing step, the wings may then be further deflected to assume a position folded over directly adjacent to the body of the paper clip but slightly spaced therefrom. Then in a separate manufacturing step, the exterior edge of the paper clip is then completely severed which may include the aforementioned non-severed section. Then the paper clip is to be completely removed from the sheet of metal. In an alternate method, the exterior edges of the wings could be severed prior to placing the overall configuration on the outer surface of the thin sheet of metal or composite.

The primary objective of the present invention is to provide another method of making a paper clip where a reasonable number of paper clips can be manufactured quickly and easily producing an exceedingly small number of rejects.

Another objective of the present invention is to utilize a method of making a paper clip which will minimize the overall cost of manufacture of the paper clip, thereby permitting the paper clip to be sold to the ultimate consumer at a reasonable cost.

Another objective of the present invention is to utilize a method of making a paper clip that produces an exceedingly attractive paper clip which may be personalized thereby making the paper clip more desirable in the market place.

Another objective of this invention is to produce individualized versions of paper clips in reasonable volume at an inexpensive cost.

DETAILED DESCRIPTION OF THE SHOWN EMBODIMENT

Figure 1:
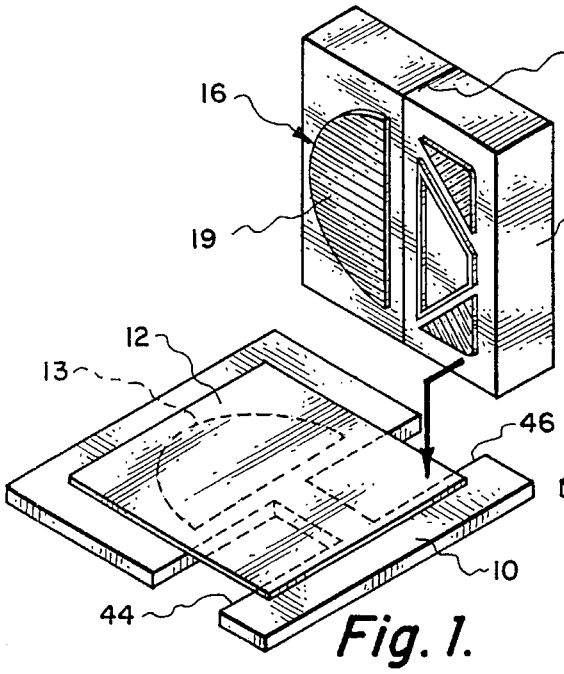
FIG. 1 is a diagrammatic isometric view depicting the manufacturing first step of the main embodiment of this invention embossing the overall configuration of the paper clip onto a thin sheet of metal or composite with male and female embossing inserts.

Referring particularly to the drawing there is shown a base 10 which will normally comprise the platen of a stamping machine (not shown). The female 13 of the stamped configuration will be impressed upon the base 10. The male configuration 19 of the facia will connect with the female 13 during the operation. Located on the base 10 is a thin sheet 12 of metal or composite. The thin sheet 12 of metal or composite is normally plain, varnished, painted, printed, adhesive coated or laminated to achieve the desired appearance or application of the paper clip in the market. Numerous types of metal could be utilized with a foil or near foil gauge being preferred. Alloys of lead, tin, gold, and steel would be common, with aluminum being preferred. Composite could also be used. It is important that the metal or composite be bendable and when bent, remain in the bent position. The material must have sufficient strength and for that reason a thickness of about 0.006 inches is required. However, it is to be understood that the thickness can readily vary in order to achieve the end result of having a certain amount of rigidity but capable of bending and assuming that bent configuration. It is to be understood in actual practice that the sheet 12 may be substantially wider than what is shown in the drawing. Also in the drawing there is shown a single embossing housing 14 upon which is formed the embossing configuration 16. The embossing housing 14 will most likely be constructed in two parts separated at line 15. The embossing housing 14 will be carried by the die (not shown). It is to be understood in actual practice there would probably be up to five or more of the embossing configurations 16 so that up to five or more paper clips 17 will be formed in a single stamping operation thereby increasing the economic feasibility of the product. It is to be understood that the various progressional stages of the method of this invention may vary in sequence or position and function to achieve the most efficient production method. For the actual configuration of the paper clip 17, reference is to be made to the foregoing U.S. Pat. No. 5,272,792. It is only important to note that the embossing configuration 16 is to include wings 18 and 20 which allow for expansion in the folding area of the paper clip to accommodate various thicknesses of documents. This folding area may incorporate double score lines or a raised area which achieve ]the same function. The male/female embossing housing 14 may comprise two parts connected together. The facia area 19 may be changed to accommodate for individual logoization. This logoization will normally be located within the facia area 19. The remaining embossed portion of the paper clip is not normally changed.

Figure 2:
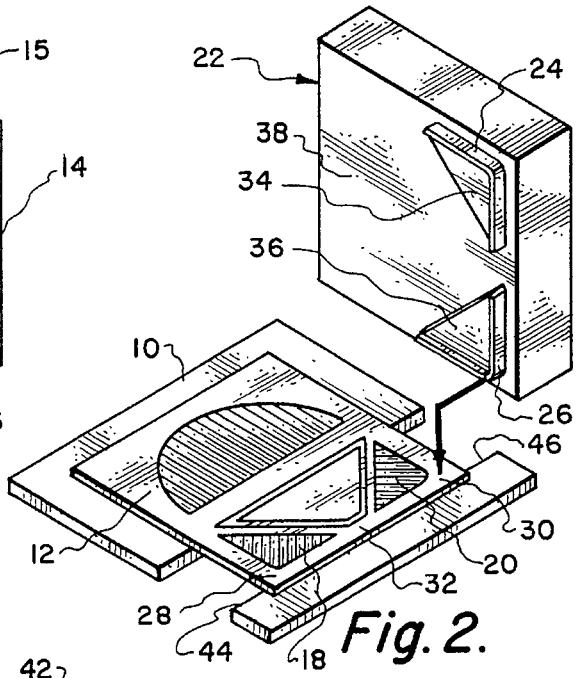
FIG. 2 is a diagrammatic isometric view depicting the severing of the exterior edge of each of the wings formed within the paper clip and also partially deflecting of the wings to a canted position.
Figure 3:
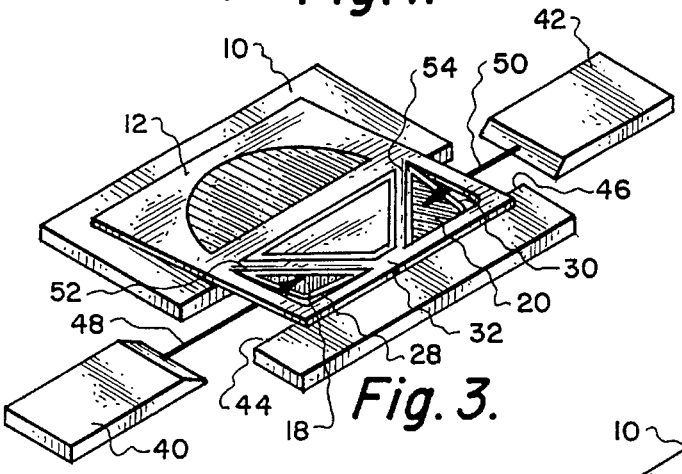
FIG. 3 is an isometric view depicting the manufacturing step of further deflecting of the wings to be in juxtaposition with the sheet of metal.
Figure 4:
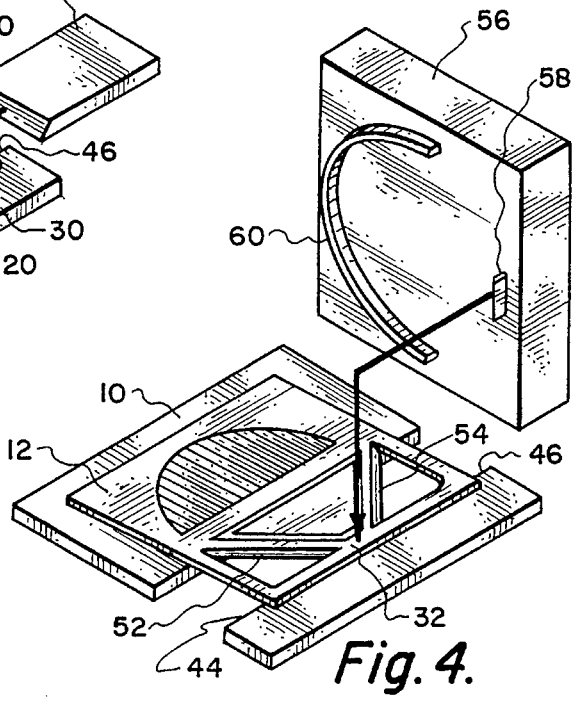
FIG. 4 is an isometric view depicting the further manufacturing step of severing of the rest of the periphery of the paper clip from the sheet of metal.

The embossing housing 14 is to be moved by machinery (not shown) forming the embossing configuration 16 within the sheet 12. This configuration is shown in FIGS. 2, 3 and 4 of the drawings. In FIG. 2, a cutting die 22 which includes cutters 24 and 26 is to be impressed on the sheet 12 in a position so that cutter 24 will severe the peripheral edge 28 of the wing 18 and the cutter 26 will severe the peripheral edge 30 of the wing 20. It is to be noted that the cutters 24 and 26 may be spaced slightly apart to form a non-severed section 32 between the wings 18 and 20. In the alternative, the cutters 24 and 26 could be used to severe the respective peripheral edges 30 and 28 and the non-severed section 32 prior to the embossing of the configuration of the paper clip on the thin sheet of metal 12 or composite.

Associated with the cutter 24 and located internally of the cutting edge of the cutter 24 is a raised area 34 with a similar raised area 36 as part of the cutter 26. These raised areas 34 and 36 are normally Similar and are raised off the surface 38 of the cutting die 22. The purpose of the raised area 34 is to cause the wing 18 to deflect slightly to the canted position beneath the plane established by the lower surface of the sheet 12. The raised area 36 is to accomplish the same objective for the wing 20. Base 10 includes appropriate recesses which may include suction or air jet apparatus 44 and 46 to permit the wings 18 and 20 to deflect. It is understood that base 10 shall vary in configuration as required at each step of the stamping line (not shown) when the base 10 is stationary and only the sheet 12 moves.

Figure 5:
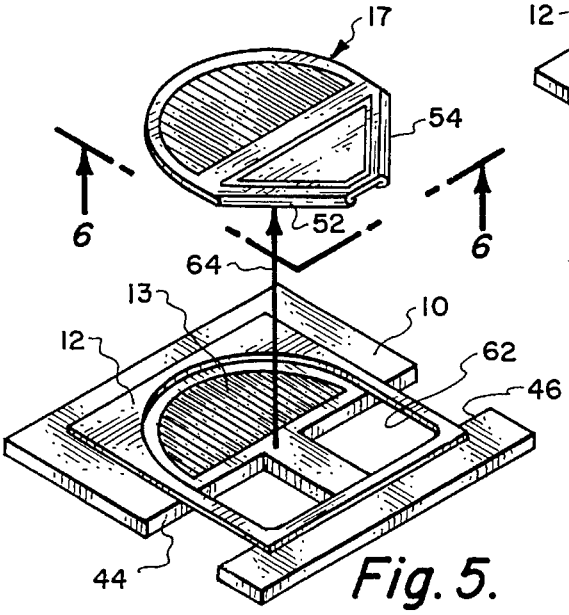
FIG. 5 is an isometric view depicting removing of the paper clip from the sheet of metal showing the top surface of the paper clip.
Figure 6:
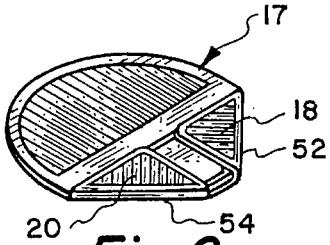
FIG. 6 is an isometric view of the bottom surface of the paper clip.

As the sheet 12 continues to move along to the next station, the deflected wings 18 and 20 are to be contactable by plungers 40 and 42 respectively. The use of the plungers 40 and 42 is shown in FIG. 3 with plunger 42 being slidable within recess 44 and plunger 42 being slidable within recess 46. It is to be understood that in actual practice the configuration of the plungers 40 and 42 may vary from what is shown in FIG. 3 with the forward end of each of the plungers 40 and 42 being specifically designed so as to press against the wings 18 and 20 and cause such to be deflected back in juxtaposition with the bottom surface of the paper clip 17. It is to be understood that the final position of the wings may vary from only being slightly bent to complete reverse deflection directly adjacent the bottom surface of the paper clip 17. This position reduces the number of manual folding operations of the paper clip 17 required by the user to secure the corner of the documents. This type of arrangement for the wings 18 and 20 is shown in FIGS. 5 and 6 of the drawings. It is to be understood that there will be a slight space between the bottom surface of the main body of the paper clip 17 and the wings 18 and 20 so that the desired number of pieces of paper can be slid therebetween. It is also to be understood that plunger 40 may be moved against the wing 18 at a different angle than is shown in FIG. 3 with the same being true for plunger 42. In FIG. 3 the direction of movement of the plunger 40 is represented by arrow 48. The direction of movement of the plunger 42 is represented by arrow 50. It is to be noted that the plungers 40 and 42 are moved in close proximity to the undersurface of the sheet 12 so as to come into contact with the deflected wings 18 and 20. Also the direction represented by arrow 48 will probably be perpendicular to the bend line 52 of the wing 18 with the arrow 50 being perpendicular to the bend line 54 of the wing 20. The wings 18 and 20 may be spaced from each other as shown in the drawing of FIG. 6 or may interconnect as with interlocking fingers.

The non-severed section 32 is substantially aligned with the bend lines 52 and 54 coinciding with the point of intersection of the bend lines 52 and 54. This arrangement insures that when the plungers 40 and 42 are moved to deflect the wings 18 and 20 that the only bending that occurs is at the bend lines 52 and 54. It is understood that the function of the non-severed section 32 could be replaced with a retracting cam or other base which will provide needed support during the deflecting of the wings 18 and 20.

Referring particularly to FIG. 4, there is shown another cutting die 56. The cutting die 56 includes a short length cutter 58 and an arcuate cutter 60. As the sheet 12 moves along to the next station, when the cutting die 56 is brought down against the configuration of the paper clip on the sheet 12, the short cutter 58 will then severe the previously non-severed section 32 with cutter 60 severing the remaining edge of the paper clip 17. At this particular time the entire severed edge 62 is produced within the sheet 12 with the paper clip 17 being free to be removed from the sheet 12 as depicted within FIG. 5 by the arrow 64. The paper clip 17 is then free to be used in the manner as is intended.

What is claimed is:

1. The method of making a paper clip comprising sequentially the steps of:

placing the overall configuration of a paper clip onto an outer planar surface of a thin sheet of rigid yet bendable material where the configuration includes the body of the paper clip and an adjacent pair of spaced-apart wings with there being an exterior edge formed between the overall configuration of the paper clip which includes the wings of the paper clip and the thin sheet of rigid yet bendable material; then severing only the exterior edge at said wings from the sheet of rigid yet bendable material leaving the remaining portion of the exterior edge unsevered; then partially deflecting the wings to a canted position relative to the sheet of rigid yet bendable material creating a bend line between each wing and the body of the paper clip; then severing the remaining exterior edge of the paper clip; and then removing the paper clip from the remaining exterior edge and the sheet of bendable material.

2. The method of making a paper clip as defined in claim 1 wherein between the partially deflecting step and the second severing step there is included the additional step of:

further deflecting the wings by forcing the wings in juxtaposition with the body of the paper clip.

3. The method of making a paper clip as defined in claim 2 wherein the placing step constitutes stamping.

4. The method of making a paper clip as defined in claim 1 wherein the first severing step includes leaving a non-severed section located between the wings and the second severing step includes severing this non-severed section.

5. The method of making a paper clip as defined in claim 4 wherein:

locating the non-Severed section to coincide with the point of intersection of the bend lines of the wings.

6. The method of making a paper clip as defined in claim 5 wherein between the partially deflecting step and the second severing step there is included the additional step of:

further deflecting the wings by forcing the wings in juxtaposition with the body of the paper clip.

7. The method of making a paper clip that has bendable wings where the wings have exterior edges that are to be part of the overall exterior edge of the paper clip, the method comprising sequentially the steps of:

severing only the exterior edges of said wings from a sheet of rigid yet bendable material leaving a remaining portion of the exterior edge unsevered; then placing the overall configuration of the paper clip onto the sheet of rigid yet bendable material where the configuration includes the body of the paper clip and the wings with the wings being spaced-apart;

partially deflecting the wings to a canted position relative to the sheet of rigid yet bendable material creating a bend line between each wing and the body of the paper clip; then severing the remaining exterior edge of the paper clip; and then removing the paper clip from the remaining exterior edge and the sheet of bendable material.

8. The method of making a paper clip as defined in claim 7 wherein between the partially deflecting step and the second severing step there is included the additional step of:

further deflecting the wings by forcing the wings in juxtaposition with the body of the paper clip.

9. The method of making a paper clip as defined in claim 8 wherein the placing step constitutes stamping.

10. The method of making a paper clip as defined in claim 7 wherein the first severing step includes leaving a non-severed section located between the wing and the second severing step includes severing this non-severed section.

11. The method of making a paper clip as defined in claim 10 wherein:

locating the non-severed section to coincide with the point of intersection of the bend lines of the wings.

12. The method of making a paper clip as defined in claim 11 wherein between the partially deflecting step and the second severing step there is included the additional step of:

further deflecting the wings by forcing of the wings in juxtaposition with the remaining body of the paper clip.

* * * * *